US010764695B2

(12) United States Patent
Abadia et al.

(10) Patent No.: US 10,764,695 B2
(45) Date of Patent: Sep. 1, 2020

(54) BTE HEARING INSTRUMENT COMPRISING AN OPEN-END TRANSMISSION LINE ANTENNA

(71) Applicant: Sonova AG, Staefa (CH)

(72) Inventors: Javier Abadia, Neuchatel (CH); Yves Oesch, Neuchatel (CH); Francois Callias, Fontaines (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/469,682

(22) PCT Filed: Dec. 20, 2016

(86) PCT No.: PCT/EP2016/081909
§ 371 (c)(1),
(2) Date: Jun. 14, 2019

(87) PCT Pub. No.: WO2018/113920
PCT Pub. Date: Jun. 28, 2018

(65) Prior Publication Data

US 2020/0015023 A1 Jan. 9, 2020

(51) Int. Cl.
*H04R 25/00* (2006.01)
*H01Q 1/27* (2006.01)
(Continued)

(52) U.S. Cl.
CPC ..... *H04R 25/554* (2013.01); *H01Q 1/273* (2013.01); *H01Q 1/36* (2013.01); *H01Q 13/08* (2013.01);
(Continued)

(58) Field of Classification Search
CPC ..... H04R 25/554; H04R 25/552; H04R 2225/025; H04R 2225/51; H01Q 1/273; H01Q 1/36; H01Q 13/08
(Continued)

(56) References Cited

U.S. PATENT DOCUMENTS 9,369,813 B2 6/2016 Kvist
9,466,876 B2 10/2016 Kerselaers et al.
(Continued)

FOREIGN PATENT DOCUMENTS

EP 2458675 A2 5/2012
EP 2723101 A2 4/2014
(Continued)

OTHER PUBLICATIONS

European Patent Office, International Search Report, dated Aug. 30, 2017, 2 pages, European Patent Office, P.B. 5818 Patentlaan 2, NL-2280 HV Rijswijk.

*Primary Examiner* — Sean H Nguyen
(74) *Attorney, Agent, or Firm* — ALG Intellectual Property, LLC

(57) ABSTRACT

There is provided a hearing instrument comprising a BTE part (10) to be worn behind the ear of a user, the BTE part comprising: a first side, a second side substantially parallel to the first side, and a third side connecting the first side and the second side, wherein the third side is substantially perpendicular to the user's skin when the BTE part is worn behind the ear, an antenna (24), and a transceiver (12) designed for transmission and reception at frequencies from 1 to 6 GHz and connected to the antenna via a non-radiating bifilar transmission line (40).

20 Claims, 4 Drawing Sheets

(51) Int. Cl.
*H01Q 1/36* (2006.01)
*H01Q 13/08* (2006.01)

(52) U.S. Cl.
CPC ..... *H04R 25/552* (2013.01); *H04R 2225/025* (2013.01); *H04R 2225/51* (2013.01)

(58) Field of Classification Search
USPC ..... 381/330
See application file for complete search history.

(56) References Cited

U.S. PATENT DOCUMENTS

| | | | | |
|---|---|---|---|---|
| 2010/0158295 | A1* | 6/2010 | Polinske | H01Q 1/243 381/323 |
| 2014/0010393 | A1* | 1/2014 | Kvist | H04R 25/554 381/315 |
| 2014/0185848 | A1* | 7/2014 | Ozden | H04R 25/554 381/315 |
| 2014/0321685 | A1* | 10/2014 | Rabel | H01Q 1/44 381/324 |
| 2015/0131831 | A1* | 5/2015 | Akdeniz | H04R 25/554 381/315 |
| 2015/0318603 | A1* | 11/2015 | Kerselaers | H04B 13/005 381/315 |
| 2016/0050502 | A1 | 2/2016 | Kvist et al. | |
| 2016/0241973 | A1 | 8/2016 | Murray et al. | |

FOREIGN PATENT DOCUMENTS

| | | | |
|---|---|---|---|
| EP | 2871860 | A1 | 5/2015 |
| WO | WO 2012/059302 | A2 | 5/2012 |
| WO | WO 2014/090419 | A1 | 6/2014 |
| WO | WO 2016/130590 | A1 | 2/2016 |

* cited by examiner

BTE HEARING INSTRUMENT COMPRISING AN OPEN-END TRANSMISSION LINE ANTENNA

The invention relates to a hearing instrument comprising a part to be worn behind the ear of a user (i.e. a Behind-The-Ear (BTE) part) comprising an antenna.

In general, different types of antennas may be used with BTE hearing instruments.

WO 2012/059302 A2 relates to an antenna known as "inverted-L antenna", which may be used in e.g. in a BTE hearing aid and which is a vertical antenna having a short vertical element prolonged by a wire parallel to a conductive ground plane. The antenna operates like a monopole folded by 90° and creates a capacitive effect causing the overall length of the antenna to be slightly shorter than $\lambda/4$. Typically, such antennas are used on the short wave frequencies, below 10 MHz.

EP 2 458 675 A2 relates to an antenna for a BTE hearing aid having a first L-shaped part placed on one side of the hearing aid housing and a second part having the form of a meander line and being placed on the opposite side of the housing, with a conductive part connecting the two parts. The antenna excitation point is between the first part and the conductive part.

EP 2 723 101 A2 relates to a BTE hearing aid having a balanced antenna for use at 2.4 GHz, which comprises a first resonant structure located on one side of the housing and a second resonant structure symmetric with regard to the first resonant structure and located on the opposite side of the housing, with a conductive segment providing a current bridge between the two resonant structures, wherein each resonant structure is fed through a transmission line. The resonant structures may have the form of a straight line, a meander line, a sheet or a closed oval line. EP 2 871 860 A1 relates to a variant of such antenna type, wherein the first resonant structure is fed through a transmission line, and the feeding point of the second resonant structure is connected to the ground plane of the electronic module.

US 2016/0183015 A1 relates to a BTE hearing aid comprising an antenna having two arms which are separated by a slot and extend in parallel along the length of the upper side of the housing. The arms comprise loading wings angled by about 90° with regard to the arms and extending along the sides of the housing adjacent to the upper side of the housing.

WO 2016/130590 A1 relates to a BTE hearing aid comprising an antenna comprising two arms, each of which extends along one of the lateral sides of the housing, with the arms being connected at one end by a conducting bridge.

U.S. Pat. No. 9,466,876 B2 relates to an antenna for a BTE hearing aid which comprises two arc-shaped conducting elements extending along the sides of the housing parallel to the user's skin and being connected by a conducting bridge in a middle portion.

WO 2007/112838 A1 relates to an RF receiver device which may be connected to a BTE hearing aid via a three pin plug connector and which comprises a magnetic loop antenna on a flexible printed circuit board (PCB) comprising two parts which are oriented at an angle of about 90° relative to each other.

It is an object of the invention to provide for a hearing instrument comprising a part to be worn behind the ear of a user and including an antenna which should be efficient both for wireless communication via a binaural link and for wireless communication with remote devices.

According to the invention, this object is achieved by a hearing instrument as defined in claim 1.

The invention is beneficial in that, by providing the antenna a radiating bifilar transmission line having an open connection at one end and comprising two spaced-apart conducting legs parallel to each other and connected at the end opposite to the open end by an impedance matching base portion configured to match the impedance of the antenna to the impedance of a non-radiating transmission line, wherein each leg extends in one of the opposed peripheral regions along the length of a side of the BTE part perpendicular to the user's skin in such a manner that the open end faces the battery of the BTE part, the antenna enables high radiation efficiency along the head surface.

Preferred embodiments of the invention are defined in the dependent claims.

Hereinafter, examples of the invention will be illustrated by reference to the attached drawings, wherein.

Figure 1:
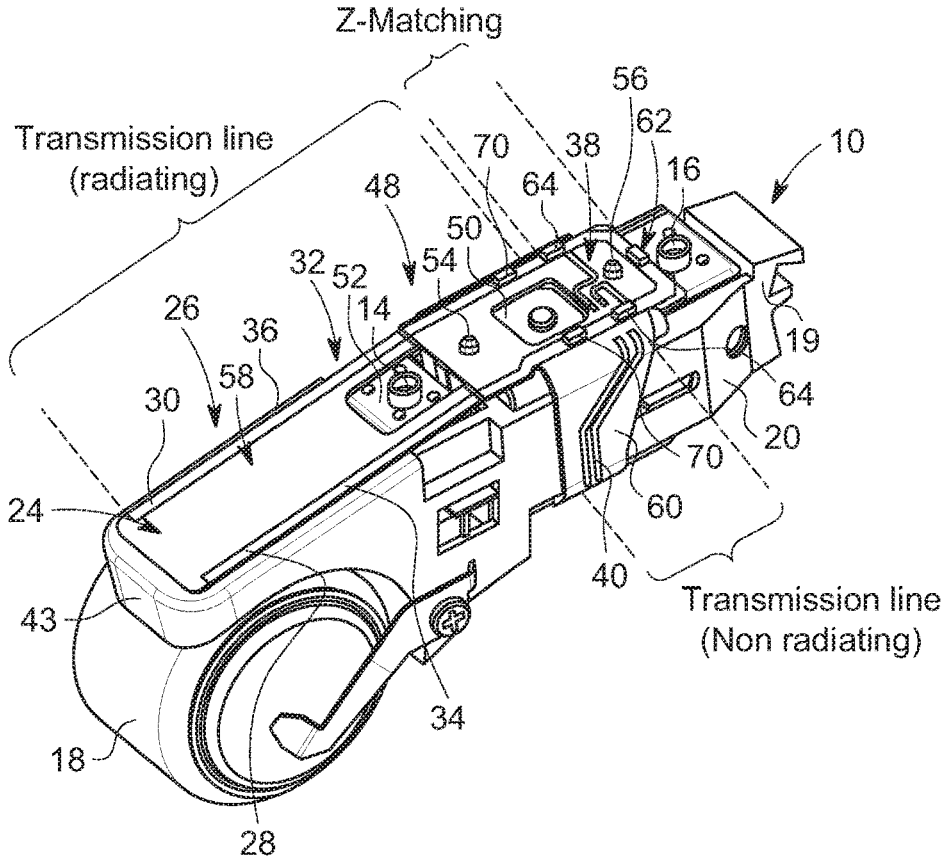
FIGS. 1 and 2 are two different perspective views of an example of components of a BTE part of a hearing instrument according to the invention.
Figure 2:
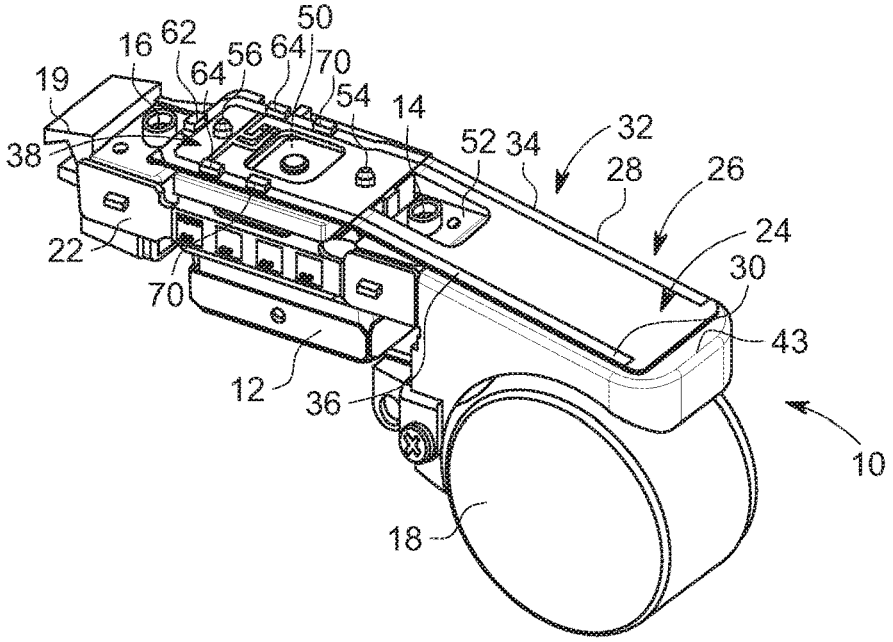

FIGS. 1 and 2 relate to a BTE part 10 of a hearing instrument, which is to be worn behind the ear of a user. The hearing instrument may be, for example, a BTE hearing aid (wherein the speaker is located in the BTE part) or a RIC hearing aid (wherein the speaker is located in the ear canal and is electrically connected to the BTE part). Alternatively, the hearing instrument may be an implantable hearing prosthesis, such as a cochlear implant system, wherein the BTE part 10 then is a BTE sound processor.

The BTE part 10 comprises a housing (not shown) and has a first side substantially parallel to the user's skin when the housing is worn behind the ear, a second side substantially parallel to the first side and a third side connecting the first side and the second side and oriented substantially upwardly when the housing is worn behind the ear; the third side thus is substantially perpendicular to the user's skin.

The BTE part 10 further comprises a radio circuit 12 acting as an RF transmitter or transceiver, a first microphone 14, a second microphone 16, a battery 18, a frame 20 made of plastic material for supporting components of the BTE part, electronic circuitry 22 and an antenna 24 placed on the upper side of the hearing instrument (i.e. the antenna 24 is primarily located at the third side of the BTE part). Typically, the BTE part 10 includes additional components which are not shown in the Figures, such as a user interface with at least one push button, a speaker, etc. In the example of FIGS. 1 and 2 the BTE part 10 is part of BTE hearing aid of the RIC (receiver in the channel) type, with the BTE part 10 comprising an RIC connector 19 at one end.

The transmitter/transceiver 12 is designed for transmission at frequencies from 1 to 6 GHz, preferably from 2.40 to 2.48 GHz.

The antenna 24 comprises a radiating bifilar transmission line 26 comprising a conductor 32 having a U-shaped contour comprising a first leg 34 and a second leg 36 which are connected by an impedance matching base portion 38 and which have open ends 28, 30. The conductor 32 is located at the upper side of the BTE part 10, i.e. it is located at and substantially parallel to the upwardly oriented third side of the housing.

The legs 34, 36 are parallel to each other and preferably extend over most (typically at least two thirds) of the length of the third side of the housing. The distance between the legs 34, 36 typically is at least 2.0 mm and the width of each leg 34, 36 typically is from 0.2 to 1.0 mm.

The open ends (or antenna tips) 28, 30 of the legs 34, 36 are located closer to the battery 18 than the base portion 38, i.e. open ends 28, 30 of the legs 34, 36 are oriented towards the battery 18, and typically extend past a boundary of the battery 18 and over at least part of the battery 18. A plastic frame 43 is provided between the battery 18 and the open ends 28, 30 of the legs so as to provide for a minimum spacing of 0.2 to 1 mm between the battery 18 and the legs 34, 36.

As illustrated in the example of FIGS. 1 and 2, the conductor 32 and the impedance matching base portion 38 may be formed on a flexible PCB 48 which has an opening 50 for a push button of the user interface and an opening 52 for the first microphone 14. Additional openings may be provided for fixation of the PCB 48, as indicated by the fixation elements 54 and 56.

According to the example of FIGS. 1 and 2, the PCB 48 comprises, in addition to the first portion 58 on which the loop conductor 32 is implemented, a second portion 60 on which the non-radiating transmission line 40 is implemented, with the second portion 60 with the transmission line 40 being folded by about 90° with regard to the first portion 58, with the second portion 60 being located at substantially parallel to the first or second side of the BTE part 10.

According to one example, the conductor 32 may have a substantially planar configuration (within 5 degrees). However, the legs 34, 36 preferably are curved or angled along their length between the open end 28, 30 and the end connected to the base portion 38 by more than 5° and less than 20° in order to allow for a curvature of the respective side of the housing.

The structure of the antenna 24 is differential, so that it does not require any ground plane to work properly. The antenna 24 is fed by a non-radiating bifilar transmission line 40 which is connected to the conductor 32 through the impedance matching base portion 38, thereby forming a differential feed structure connected to each of the legs 34, 36 at a feed point 44 and 46, respectively. In the example of FIGS. 1 and 2 the impedance matching base portion 38 comprises a central shunt matching element 62 in a portion 61 connecting the ends of the legs 34, 36 and two lateral serial matching elements 64, one for each of the legs 34, 36. In the example of FIGS. 1 and 2 each one of the two strands of the non-radiating transmission line 40 is connected to a different one of the legs 34, 36 of the radiating transmission line in such a manner that the respective feed point 44, 46 is between the central shunt matching element 62 and the respective lateral serial matching element 64. Preferably, the feed points 44, 46 are arranged mirror-symmetric with regard to each other. Typically, the entire antenna structure is mirror-symmetric with regard to a plane extending in the longitudinal direction of the BTE part 10.

In the example of FIGS. 1 and 2 each leg 34, 36 is provided with a serial tuning element 70 at a position close to the impedance matching base portion 38 for tuning of the antenna resonance frequency, in particular in case that the length of the legs 34, 36 does not match with the desired antenna resonance frequency, as will be explained in more detail below.

Figure 3:
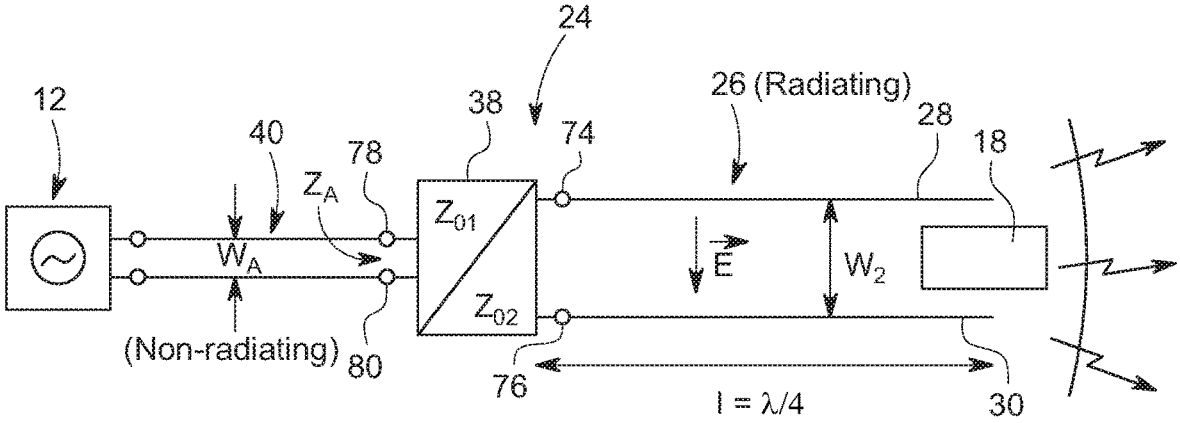
FIG. 3 is a schematic circuit diagram of an example of an antenna according to the invention.

FIG. 3 is a schematic circuit diagram of an example of an antenna according to the invention, wherein the antenna 24 is formed by a radiating transmission line 26 (which is implemented in the example of FIGS. 1 and 2 by the legs 34, 36 formed as a conductor 32 on a PCB 48), which has its open end/tip 28, 30 located at the battery, wherein the input nodes 74, 76 are connected to the output of the impedance matching portion 38. The input of the impedance matching portion 38 is connected to the output nodes 78, 80 of the non-radiating transmission line 40, the input nodes of which are connected to the radio transceiver 12. The transmission line 40 is a bifilar transmission line and has a width $W_1$ which is much smaller than the wavelength of the radio waves supplied by the transceiver 12. The bifilar radiating transmission line 26 has a relatively large width $W_2$ (which is at least 2.0 mm) and an electrical length/corresponding to a quarter wavelength of the radio frequency of the signal supplied by the transceiver 12, so that the transmission line 26 is radiating (the radiation strength increases with increasing width $W_2$ of the transmission line 26).

The matching portion 38 is required for matching the output impedance at the output nodes 78, 80 of the non-radiating transmission line 40 to the impedance seen at the input nodes 74, 76 of the radiating transmission line 26. In general, the tips 28, 30 of the radiating transmission line 26 preferably extend into the region of the battery 18 so as to maximize the length of the radiating transmission line 26 for improving the radiation performance. However, some spacing should be provided between the tips 28, 30 and the battery 18 for minimizing the parasitic capacitive coupling; to this end, in the example of FIGS. 1 and 2 a plastic frame 43 is provided between the battery 18 and the tips 28, 30.

Typically, in practice, the impedance of the radiating transmission line 26 between the input nodes 74, 76 is smaller than the characteristic impedance at the output nodes 78, 80 of the non-radiating transmission line 40, so that the matching portion 38 has to provide for a transformation from a higher impedance seen between the output nodes 78, 80 to a smaller impedance seen between the antenna input nodes 74, 76.

Figure 4:
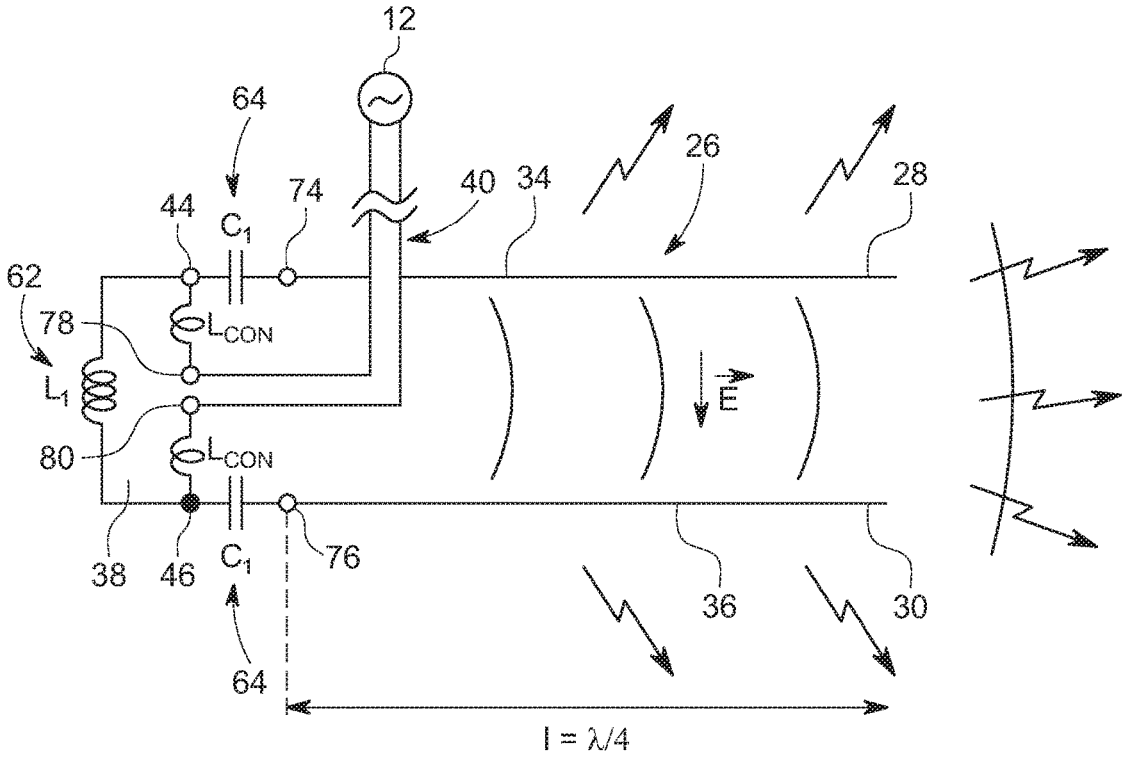
FIGS. 4 and 5 are circuit diagrams illustrating two different examples of a matching circuit for an antenna according to the invention.

In FIG. 4 a first example of an antenna 24 with a matching portion 38 is shown, wherein the impedance transformation is achieved by serial capacitors $C_1$, a shunt inductance $L_1$ and serial inductances $L_{CON}$, wherein the serial inductances $L_{CON}$ are the parasitic inductances of straight wires connecting the output nodes 78, 80 of the non-radiating transmission line 40 to the common nodes 44, 46 of the inductance $L_1$ and the respective serial capacitor $C_1$. In practice, the values of $L_{CON}$ are very small, so that their parasitic effects on the impedance transformation may be compensated by small adaptations of the values of $L_1$ and $C_1$.

According to a variant of the embodiment of FIG. 4, the parallel inductance $L_1$ may be replaced by a metallic trace having a length providing an inductance value between the nodes 44, 46 which is appropriate for the needed impedance transformation.

Figure 5:
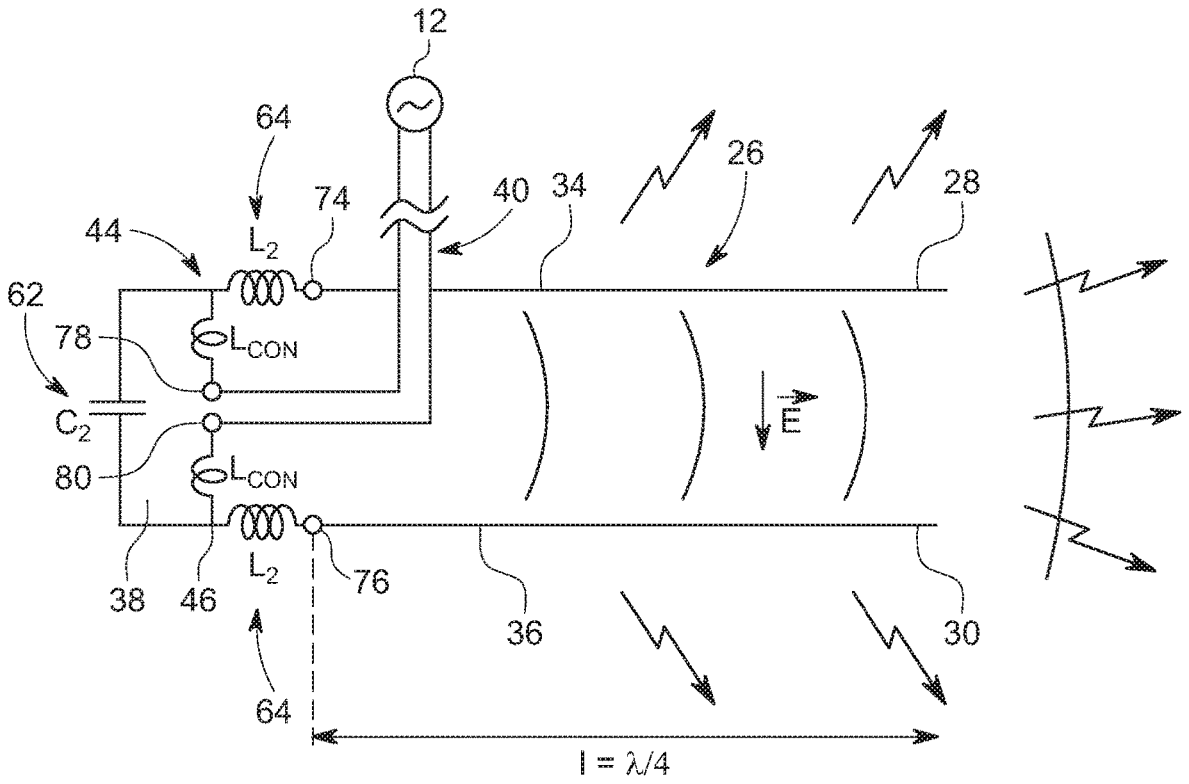

In FIG. 5 an alternative embodiment for the same impedance transformation as in the example of FIG. 4 is shown, wherein the central shunt element is a shunt capacitor $C_2$ and the two lateral serial matching elements are inductances $L_2$. The parasitic inductances $L_{CON}$ are treated in the same manner as in the embodiment of FIG. 4.

Figure 6:
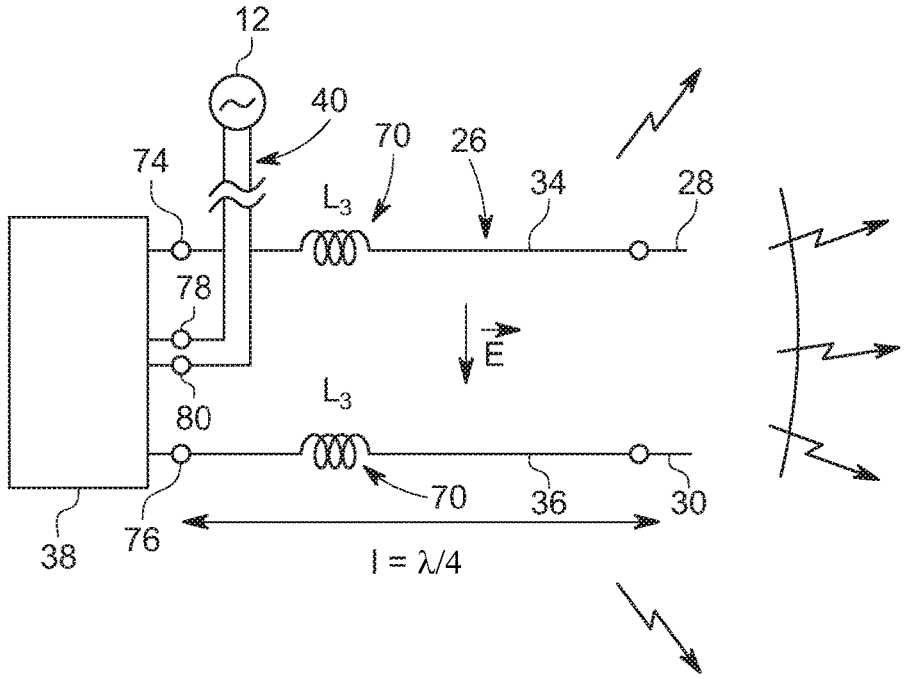
FIGS. 6 and 7 are circuit diagrams illustrating two different examples of an antenna according to the invention with serial tuning elements.

FIG. 6 is a circuit diagram illustrating an example for the serial tuning element 70 in case that the physical length of the radiating transmission line 26 is too short. In this case the serial tuning element 70 is formed by an inductance $L_3$ which is placed in serial in each of the legs 34, 36 so as to provide a $\lambda/4$ resonance in case that the length of the radiating transmission line 26, i.e. the length of the respective leg 34, 36 is less than $\lambda/4$. Thus, in this case the inductances $L_3$ serve to increase the electrical length of the radiating transmission line 26 to $\lambda/4$.

Figure 7:
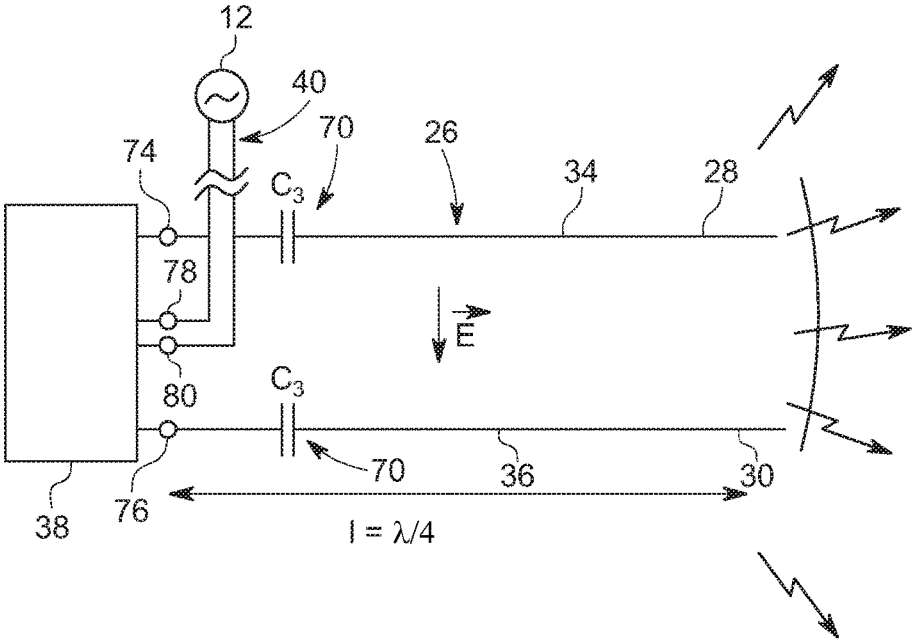

FIG. 7 shows a circuit diagram illustrating an example of the case in which the physical length of the radiating transmission line 26 is too large, i.e. is larger than $\lambda/4$. In this case a capacitor $C_3$ is placed in serial in each leg 34, 36 of the radiating transmission line 26 so as to provide for a $\lambda/4$ resonance.

It has to be noted that, for example, the inductance $L_3$ of FIG. 6 may be combined with the capacitor $C_1$ of FIG. 4 into a single component having the same serial impedance. Similarly, the inductance $L_3$ of FIG. 6 may be combined as well with the inductance $L_2$ of FIG. 5 into a single component having the same serial impedance. Similar considerations also apply for the circuit of FIG. 7 when used with one of the circuits of FIGS. 4 and 5, i.e. the serial tuning element 70 may be combined with the lateral serial matching element 64 into a single capacitor or inductance.

It is further to be noted that the impedance matching base portion 38 allows for fine tuning of both the resonance frequency and the input impedance of the antenna 24. However, fine tuning of the resonance frequency may be advantageously realized through the serial tuning elements 70.

Figure 8:
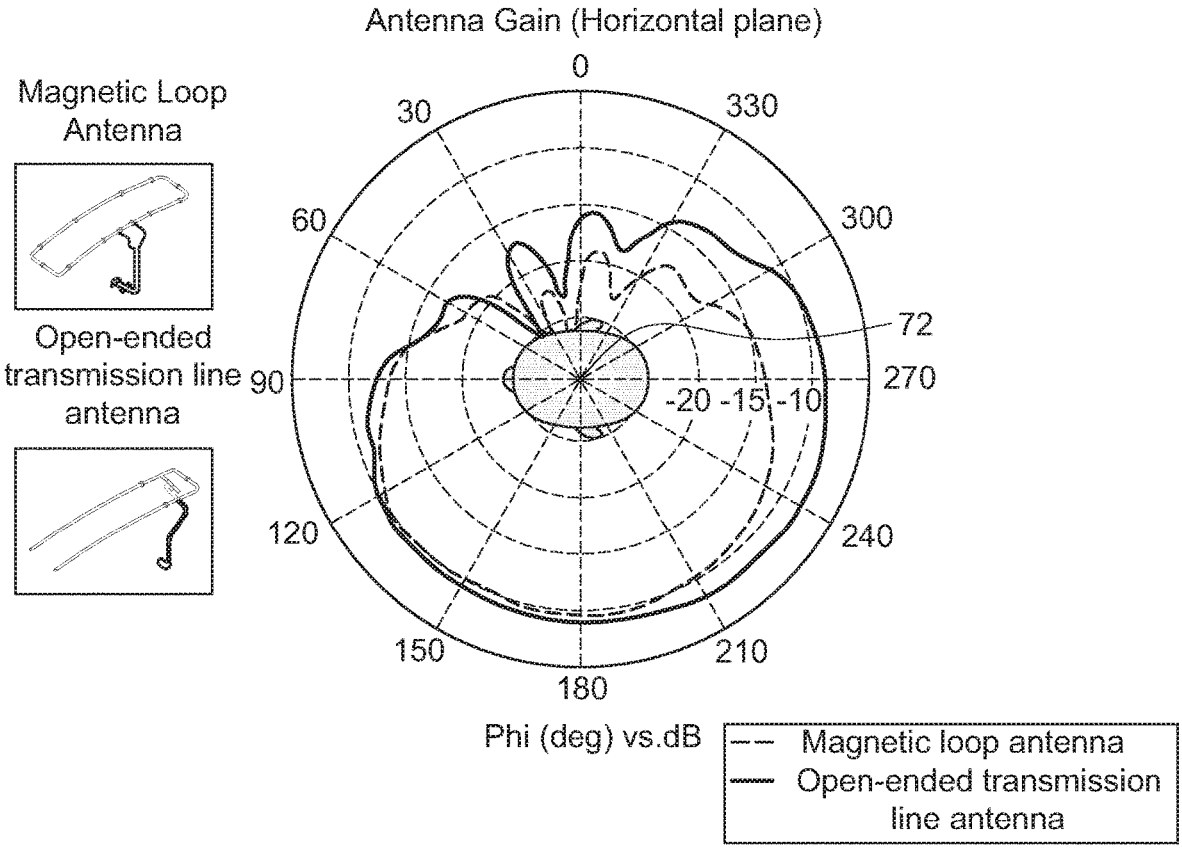
FIG. 8 is a representation of an example of the antenna gain in a horizontal plane of the user's head, wherein a conventional full magnetic loop antenna and an antenna according to the invention are compared.

The antenna of the invention produces an electromagnetic wave having an electric field component orthogonal to the skin, which is optimal for propagation by diffraction around the head. This is illustrated in FIG. 8 which compares the simulated radiation pattern of a conventional BTE part with a full size closed magnetic loop antenna and a BTE part provided with an antenna according to the invention, wherein the BTE part is placed at the left side of the head 72 between the skull and the auricle. It can be seen that the conventional magnetic loop antenna (dashed line in FIG. 8) has a radiation maximum in a direction orthogonal to the head 72 (at 180°), while the antenna according to the invention (solid line in FIG. 8) has a radiation maximum that is oriented at about 240°, between the side and the rear of the head 72, with the gain in the rearward direction (270°) being by 5 dB higher for the antenna according to the invention than for the conventional magnetic loop antenna.

The best propagation path for a binaural link is by diffraction around the neck, since this path is shorter than other paths, such as the path around the top of the head or the path around the forehead which is partly obstructed by the auricle. With the antenna of the invention in the example of FIG. 8 having 5 dB more gain in the direction of the neck than the conventional magnetic loop antenna, using the antenna of the invention in a binaural link between a left ear BTE hearing instrument and a right ear BTE hearing instrument would provide for a 10 dB advantage over a conventional magnetic loop antenna (both the antenna at the left ear and the antenna at the right ear would have 5 dB more gain in the direction of the main propagation path around the neck).

The invention claimed is:

1. A hearing instrument comprising a behind-the-ear part (BTE), the BTE part comprising:

a first side, a second side substantially parallel to the first side, and a third side physically coupling the first side and the second side, wherein the third side is configured to be substantially perpendicular to skin of a user when the BTE part is worn behind an ear, an antenna, a transceiver configured for transmission and reception at frequencies from 1 to 6 GHz and connected to the antenna via a non-radiating bifilar transmission line, wherein the antenna comprises a radiating bifilar transmission line having an open connection at one end and comprising two conducting legs parallel to each other at a distance of at least 2.0 mm and connected at the end opposite to an open end by an impedance matching base portion configured to match a lower impedance of the antenna to a higher impedance of the non-radiating transmission line, wherein the non-radiating transmission line is connected via the impedance matching base portion to the antenna with two strands of the non-radiating transmission line connected to a different one of the conducting legs of the radiating transmission line, and wherein each of the conducting leg extends along a peripheral region along a length of the third side of the BTE.

2. The hearing instrument of claim 1, wherein the conducting legs of the antenna extend substantially over the entire length of the third side.

3. The hearing instrument of claim 2, wherein open ends of the conducting legs extend over at least part of the battery.

4. The hearing instrument of claim 3, wherein further includes a plastic frame is between the battery and the open ends of the conducting legs, wherein the battery and the conducting legs are by at least 0.2 mm.

5. The hearing instrument of of claim 4, wherein the antenna is formed by conductors on a flexible PCB.

6. The hearing instrument of claim 5, wherein the PCB comprises at least one of an opening for a microphone and an opening for a push button between the two conducting legs.

7. The hearing instrument of claim 6, wherein the conducting legs are curved or angled along their length between the open end and the end connected to the impedance matching base portion by less than 20 degrees and more than 5 degrees.

8. The hearing instrument of claim 7, wherein the width of each of the legs is from 0.2 to 1.0 mm.

9. The hearing instrument of claim 8, wherein each leg of the antenna comprises a serial tuning element for adjusting the electrical length of the leg.

10. The hearing instrument of claim 9, wherein the serial tuning element comprises at least one serial inductor for increasing the electrical length of the leg.

11. The hearing instrument of claim 9, wherein the serial tuning element comprises at least one serial capacitor for decreasing the electrical length of the leg.

12. The hearing instrument of claim 1, wherein the impedance matching base portion comprises a central shunt matching element and two lateral serial matching elements.

13. The hearing instrument of claim 12, wherein the two lateral serial matching elements are capacitors.

14. The hearing instrument of claim 12, wherein each one of the two strands of the non-radiating transmission line is connected to a different one of the legs of the radiating transmission line at a feed point between the central shunt matching element and the respective lateral serial matching element.

15. The hearing instrument of claim 1, wherein the feed points are arranged mirror-symmetric with regard to each other.

16. The hearing instrument of claim 1, wherein the non-radiating transmission line comprises two parallel spaced apart conductors on a second portion of a PCB that includes a first portion on that the antenna is formed by a conductor.

17. The hearing instrument of claim 16, wherein the second portion (60) of the PCB (48) with the non-radiating transmission line (40) is folded with regard to the first portion (58) of the PCB.

18. The hearing instrument of claim 17, wherein the second portion (60) of the PCB (48) is substantially parallel to the first side or second side of the BTE part (10), and wherein the first portion (58) of the PCB is substantially parallel to the third side of the BTE part.

19. The hearing instrument of claim 1, wherein the transmitter or transceiver is configured for operation at frequencies from 2.40 to 2.48 GHz.

20. The hearing instrument of claim 1, wherein the BTE part is part of a hearing aid or cochlear device.

* * * * *